US006382330B2

(12) United States Patent
Bischel et al.

(10) Patent No.: US 6,382,330 B2
(45) **Date of Patent: *May 7, 2002**

(54) APPARATUS AND METHOD FOR CONTROLLING AN UNDERGROUND BORING MACHINE

(75) Inventors: Brian John Bischel, Pella; James Richard Rankin, Montezuma, both of IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/808,280

(22) Filed: Mar. 14, 2001

Related U.S. Application Data

(62) Division of application No. 09/605,594, filed on Jun. 28, 2000, which is a division of application No. 09/384,754, filed on Aug. 27, 1999, now Pat. No. 6,109,367, which is a division of application No. 08/614,532, filed on Mar. 13, 1996, now Pat. No. 5,746,278.

(51) Int. Cl.[7] ..... E21B 44/00
(52) U.S. Cl. ..... 175/24; 175/27; 175/48
(58) Field of Search ..... 175/19, 24, 26, 175/27, 40, 48

(56) References Cited

U.S. PATENT DOCUMENTS 4,787,463 A 11/1988 Geller et al.
4,953,638 A 9/1990 Dunn
5,355,965 A 10/1994 Rozendaal
5,746,278 A 5/1998 Bischel et al.
5,944,121 A 8/1999 Bischel et al.
6,289,997 B1 * 9/2001 Bischel et al. ..... 175/24

OTHER PUBLICATIONS

A. F. Kathage, "A Challenge: GPR in Advance of Horizontal Drilling," Proceedings of the Fourth International Conference on Ground Penetrating Radar, Geological Survey of Finland, Special Paper 16, pp. 119–124, Jun. 1992.

L. Landberg, "Light Equipment, Boring System Monitor Detects Changes," Construction Equipment, p. 104, May 1995.

Vermeer Manufacturing Company, D–14/D–24, Brochure, 1994.

Vermeer Manufacturing Company, D–7/D–10, Brochure, 1994.

* cited by examiner

*Primary Examiner*—William Neuder
(74) *Attorney, Agent, or Firm*—Altera Law Group, LLC

(57) ABSTRACT

An apparatus and method for controlling an underground boring machine during boring or reaming operations. A boring tool is displaced along an underground path while being rotated. In response to variations in underground conditions impacting boring tool progress along the underground path, a control system modifies the rate of boring tool displacement along the underground path while rotating the boring tool at a selected rotation rate to optimize excavation productivity. The controller may also monitor the rate at which liquid is pumped through the borehole and automatically adjust the rate of displacement and/or the liquid flow rate so that sufficient liquid is flowing through the borehole to remove the cuttings and debris generated by the boring tool.

40 Claims, 11 Drawing Sheets

APPARATUS AND METHOD FOR CONTROLLING AN UNDERGROUND BORING MACHINE

This application is a divisional of Ser. No. 09/605,594, filed Jun. 28, 2000 which is a divisional of Ser. No. 09/384,754 filed on Aug. 27, 1999, now issued U.S. Pat. No. 6,109,367 which is a divisional of Ser. No. 08/614,532, filed Mar. 13, 1996, now issued U.S. Pat. No. 5,746,278. These applications are incorporated herein by reference.

FIELD OF THE INVENTION

This invention relates to underground boring machine, and more particularly, to an apparatus and method for controlling an underground boring machine.

BACKGROUND OF THE INVENTION

Utility lines for water, electricity, gas, telephone and cable television are often run underground for reasons of safety and aesthetics. In many situations, the underground utilities can be buried in a trench which is then back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, the trench poses a danger of injury to workers and passersby.

The general technique of boring a horizontal underground hole has recently been developed in order to overcome the disadvantages described above, as well as others unaddressed when employing conventional trenching techniques. In accordance with such a general horizontal boring technique, also known as microtunnelling or trenchless underground boring, a boring system is positioned on the ground surface and drills a hole into the ground at an oblique angle with respect to the ground surface. Water is flowed through the drill string, over the boring tool, and back up the borehole in order to remove cuttings and dirt. After the boring tool reaches the desired depth, the tool is then directed along a substantially horizontal path to create a horizontal borehole. After the desired length of borehole has been obtained, the tool is then directed upwards to break through to the surface. A reamer is then attached to the drill string which is pulled back through the borehole, thus reaming out the borehole to a larger diameter. It is common to attach a utility line or conduit to the reaming tool so that it is dragged through the borehole along with the reamer.

At the commencement of an underground boring operation, the boring tool is typically rotated and advanced into the ground. As the boring tool progresses underground, the tool typically encounters soil of varying hardness. When the boring tool encounters relatively hard ground, the rate of tool rotation can decrease significantly. An increase in torque is typically imparted to the boring tool through manual manipulation of appropriate control levers in order to continue advancing the tool through the harder ground. Such an increase in torque, however, must be moderated carefully by the operator in order to avoid damaging the boring tool or other system components.

An operator of a conventional underground boring tool typically modifies the rate of boring tool advancement when the tool encounters hard soil by manipulating one or more control levers and monitoring various analog gauges. As can be appreciated, a high degree of skill and continuous attention are required on the part of the operator in order to operate the boring tool productively and safely. Maintaining optimum boring machine performance using prior art control methods is generally considered to be an exacting and fatiguing task. In addition, although a skilled operator may react quickly to dynamically changing boring conditions, human reaction time to such changes is rather slow.

There is a recognition among manufacturers of underground boring machines for a need to minimize the difficulty of operating a boring machine. There exists a further need to reduce the substantial amount of time currently required to adequately train an underground boring machine operator. Additionally, there continues a need for an improved underground boring machine that provides for high boring efficiency through varying ground conditions without depending on human intervention. The present invention fulfills these needs.

SUMMARY OF THE INVENTION

The present invention is an apparatus and method for controlling an underground boring machine during boring or reaming operations. A boring tool is displaced along an underground path while being rotated at a selected rate of rotation. In response to variations in underground conditions impacting boring tool progress along the underground path, a control system concurrently modifies the rate of boring tool displacement along the underground path while rotating the boring tool at the selected rotation rate. The controller monitors the rate at which liquid is pumped through the borehole and automatically adjusts the rate of boring tool displacement and/or the liquid flow rate so that sufficient liquid is flowing through the borehole to remove the cuttings and debris generated by the boring tool.

Sensors are provided to sense pressure levels in the rotation, displacement, and liquid dispensing pumps and an electronic controller continuously monitors the levels detected by the sensors. When the controller detects a rise in pump pressure above an unacceptable level, the controller modifies the boring tool operation by reducing the rate of its displacement along the underground path, while maintaining rotation of the boring tool at a pre-selected rate. Such modification reduces the load on the rotation pump and allows the pressures to recover to an acceptable level. The controller increases boring tool displacement along the underground path after detecting that the rotation pump pressure has fallen below a set level.

DETAILED DESCRIPTION OF THE INVENTION

The present invention relates to a control system for operating an underground boring machine and communicating the status of the boring operation to an operator.

Figure 1:
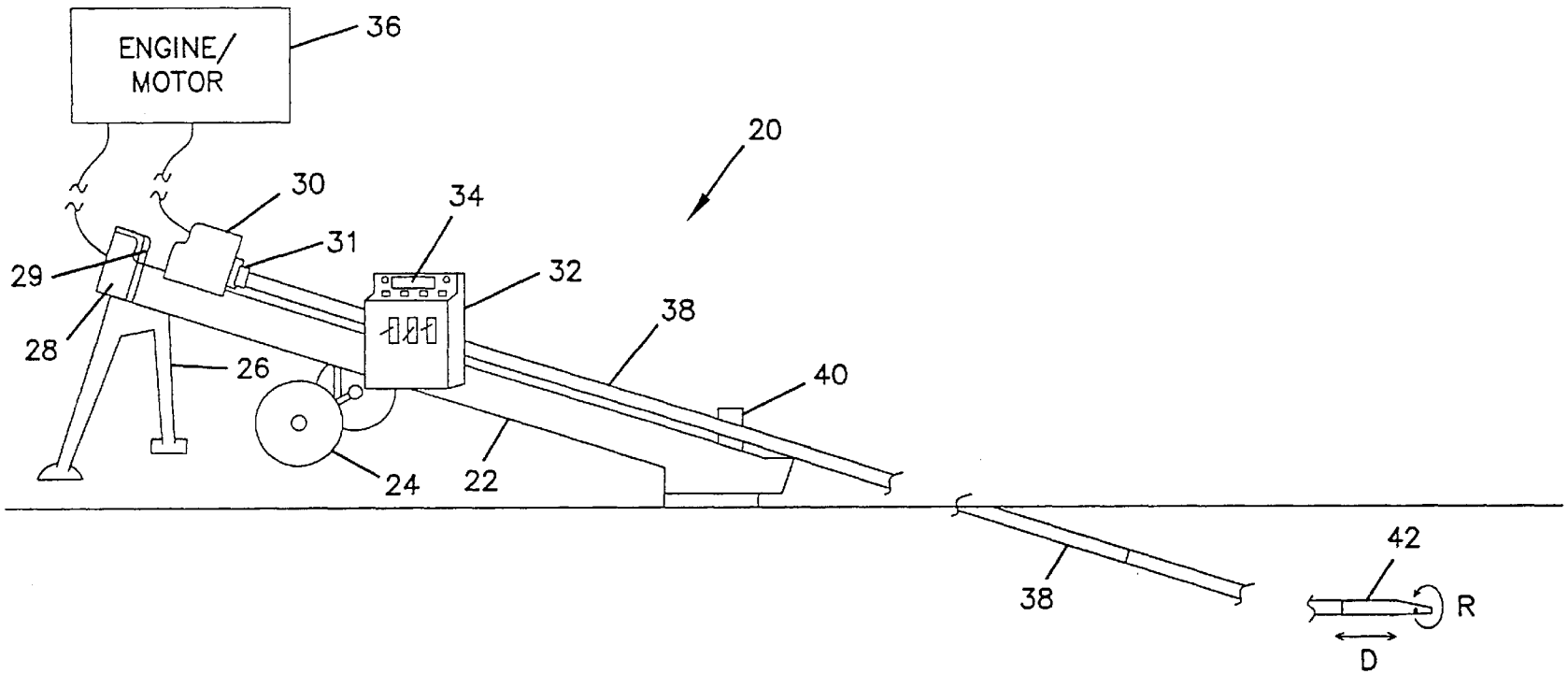
FIG. 1 is a side view of a directional boring machine incorporating a novel apparatus and method for controlling the displacement of a boring tool.

Referring now to the drawings, and more particularly to FIG. 1, there is illustrated a depiction of an underground boring machine 20 that incorporates a novel apparatus and method for controlling an underground boring tool 42. The apparatus and method for controlling the underground boring tool 42 will be described generally herein with reference to a hydrostatically powered boring machine. It will be appreciated, however, that the present invention may be advantageously implemented in a wide variety of underground boring machines having components and configurations differing from those depicted for illustrative purposes herein.

The underground boring machine 20 illustrated in FIG. 1 includes a displacement pump 28 driving a hydraulic cylinder 29, or a hydraulic motor, which applies an axially directed force to a length of pipe 38 in a forward and reverse axial direction. The displacement pump 28 provides varying levels of controlled force when thrusting the pipe length 38 into the ground to create a bore and when pulling back on the pipe length 38 when extracting the pipe length 38 from the bore during a back reaming operation. A rotation pump 30, driving a rotation motor 31, provides varying levels of controlled rotation to the pipe length 38 as the pipe length 38 is thrust into a bore when operating the boring machine 20 in a drilling mode of operation, and for rotating the pipe length 38 when extracting the pipe length 38 from the bore when operating the boring machine in a back reaming mode. An engine or motor 36 provides power, typically in the form of pressure, to both the displacement pump 28 and the rotation pump 30, although each of the pumps 28 and 30 may be powered by separate engines or motors.

The underground boring machine 20 preferably includes a coupling drive 40 for advancing and threading individual lengths of pipe 38 together. Also, mounted on the frame 22 is a wheel assembly 24 which provides a means for transporting the underground boring machine 20. A stabilizer assembly 26 is often used after positioning the boring machine 20 at a desired drilling site for purposes of stabilizing the boring machine 20 during a drilling or reaming operation. It is to be understood that the underground boring machine 20 may include left and right track drives (not shown) rather than a wheel assembly 24 for purposes of maneuvering the boring machine 20. In such a configuration, the left and right track drives may be powered by the engine/motor 36 that also powers the displacement and rotation pumps 28 and 30, or, alternatively, may be powered by an independent power source.

A control panel 32 is preferably mounted on the underground boring machine 20 which includes a number of manually actuatable switches, knobs, and levers for manually controlling the engine 36, pumps 28 and 30, motors, and other component that are incorporated as part of the underground boring machine 20. The control panel 32 also includes a display 34 on which various configuration and operating parameters are displayable to an operator of the boring machine 20. As will be described in greater detail hereinbelow, the display 34 preferably communicates to the operator various types of information associated with the operation of the boring machine 20.

Figure 2:
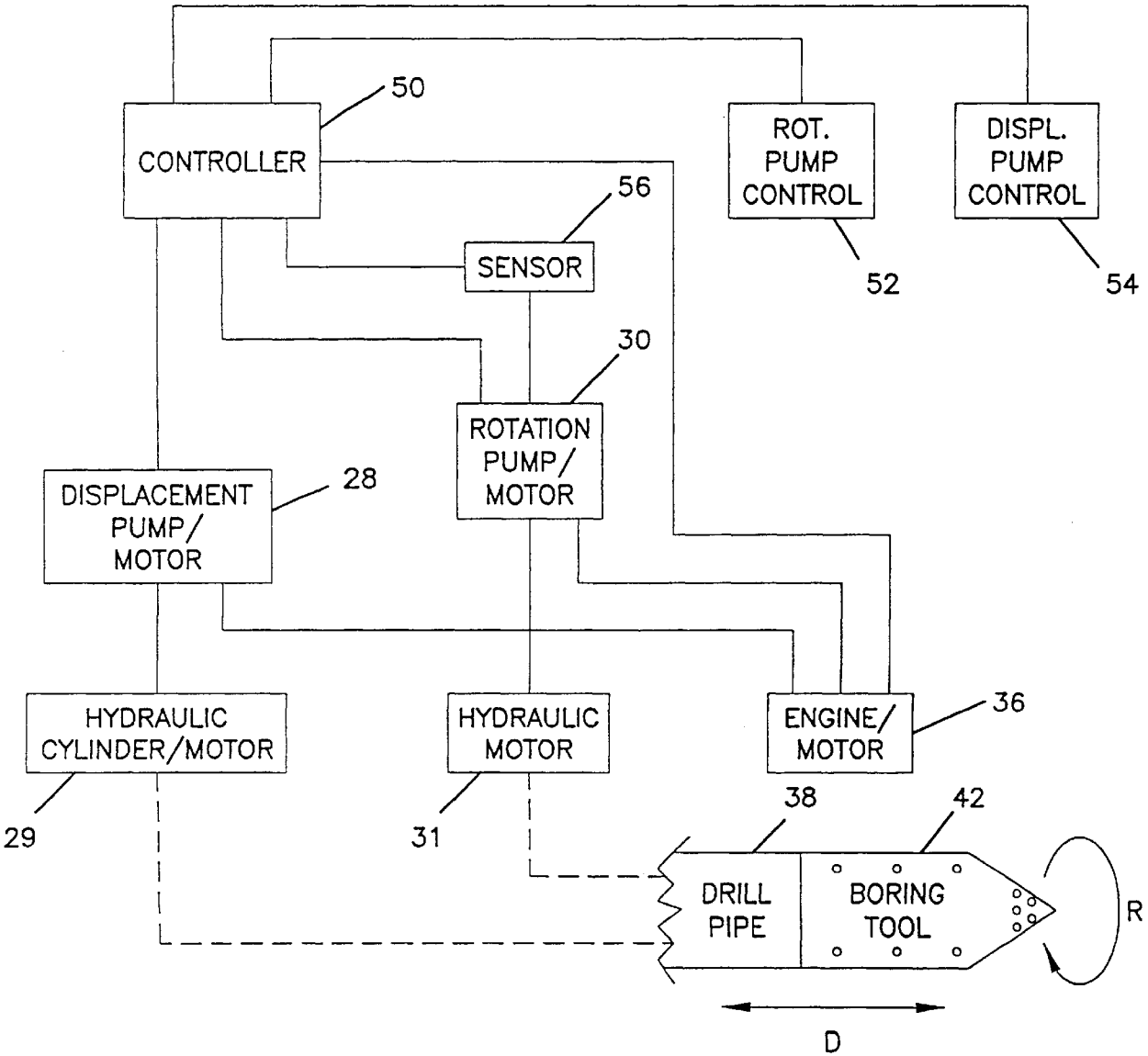
FIG. 2 is a system block diagram of a novel apparatus for controlling the displacement and rotation of an underground boring tool.

Turning now to FIG. 2, there is illustrated one embodiment of a novel apparatus for controlling the underground boring machine 20. In accordance with the embodiment illustrated in FIG. 2, it has been determined by the inventors that the overall boring efficiency of an underground boring machine 20 is increased by appropriately controlling the respective output levels of the rotation pump 30 and the displacement pump 28. More particularly, it has been determined that under dynamically changing boring conditions, automatic control of the displacement and rotation pumps 28 and 30 provides for substantially increased boring efficiency over a manually controlled methodology. Within the context of a hydrostatically powered boring machine 20 or, alternatively, one powered by a proportional valve-controlled gear pump, it has been determined that increased boring efficiency is achievable by rotating the boring tool 42 at a selected rate, monitoring the pressure of the rotation pump 30, and modifying the rate of boring tool 42 displacement in an axial direction with respect to an underground path while concurrently rotating the boring tool 42 at the selected output level in order to compensate for changes in the pressure of the rotation pump 30.

With further reference to FIG. 2, automatic modification to the operation of the displacement pump 28 and rotation pump 30 is controlled by a controller 50. The controller 50 is also preferably coupled to the engine/motor 36 which provides source power respectively to the displacement and rotation pumps 28 and 30. A rotation pump sensor 56 is coupled to the rotation pump 30 and the controller 50, and provides an output signal to the controller 50 corresponding to a pressure, or alternatively, a speed of the rotation pump 30. A rotation pump control 52 and a displacement pump control 54 provide for manual control over the rate at which drilling or back reaming is performed. During idle periods, the rotation and displacement pump controls 52 and 54 are preferably configured to automatically return to a neutral setting at which no rotation or displacement power is delivered to the boring tool 42 for purposes of safety.

In accordance with a preferred mode of operation, an operator initially sets the rotation pump control 52 to an estimated optimum rotation setting during a drilling operation and modifies the setting of the displacement pump control 54 in order to change the gross rate at which the boring tool 42 is displaced along an underground path when drilling or back reaming. The rate at which the boring tool 42 is displaced along the underground path during drilling or back reaming typically varies as a function of soil conditions, length of drill pipe 38, water flow through the drill pipe 38 and boring tool 42, and other factors. Such variations in displacement rate typically result in corresponding changes in rotation and displacement pump pressures, as well as changes in engine/motor 36 loading. Although the rotation and displacement pump controls 52 and 54 permit an operator to modify the output of the displacement and rotation pumps 28 and 30 on a gross scale, those skilled in the art can appreciate the inability by even a highly skilled operator to quickly and optimally modify boring tool 42 productivity under continuously changing soil and loading conditions.

After initially setting the rotation pump control 52 to the estimated optimum rotation setting for the current boring conditions, an operator controls the gross rate of displacement of the boring tool 42 along an underground path by modifying the setting of the displacement pump control 54. During a drilling or back reaming operation, the rotation pump sensor 56 monitors the pressure of the rotation pump 30, and communicates rotation pump 30 pressure information to the controller 50. The rotation pump sensor 56 may alternatively communicate rotation motor 30 speed information to the controller 50. Excessive levels of boring tool 42 loading during drilling or back reaming typically result in an increase in the rotation pump 30 pressure, or, alternatively, a reduction in rotation motor speed. In response to an excessive rotation pump 30 pressure or, alternatively, an excessive drop in rotation rate, the controller 50 communicates a control signal to the displacement pump 28 resulting in a reduction in displacement pump pressure so as to reduce the rate of boring tool displacement along the underground path. The reduction in the rate of boring tool displacement decreases the loading on the boring tool 42 while permitting the rotation pump 30 to operate at an optimum output level or other output level selected by the operator. The relatively high speed at which the controller 50 moderates the operation of the boring machine 20 under varying loading conditions provides for optimized boring efficiency, prevention of detrimental wear-and-tear on the boring tool 42 and boring machine pumps, motors and engines, and reduces operator fatigue by automatically modifying boring machine 20 operation in response to both subtle and dramatic changes in soil and loading conditions.

Figure 3:
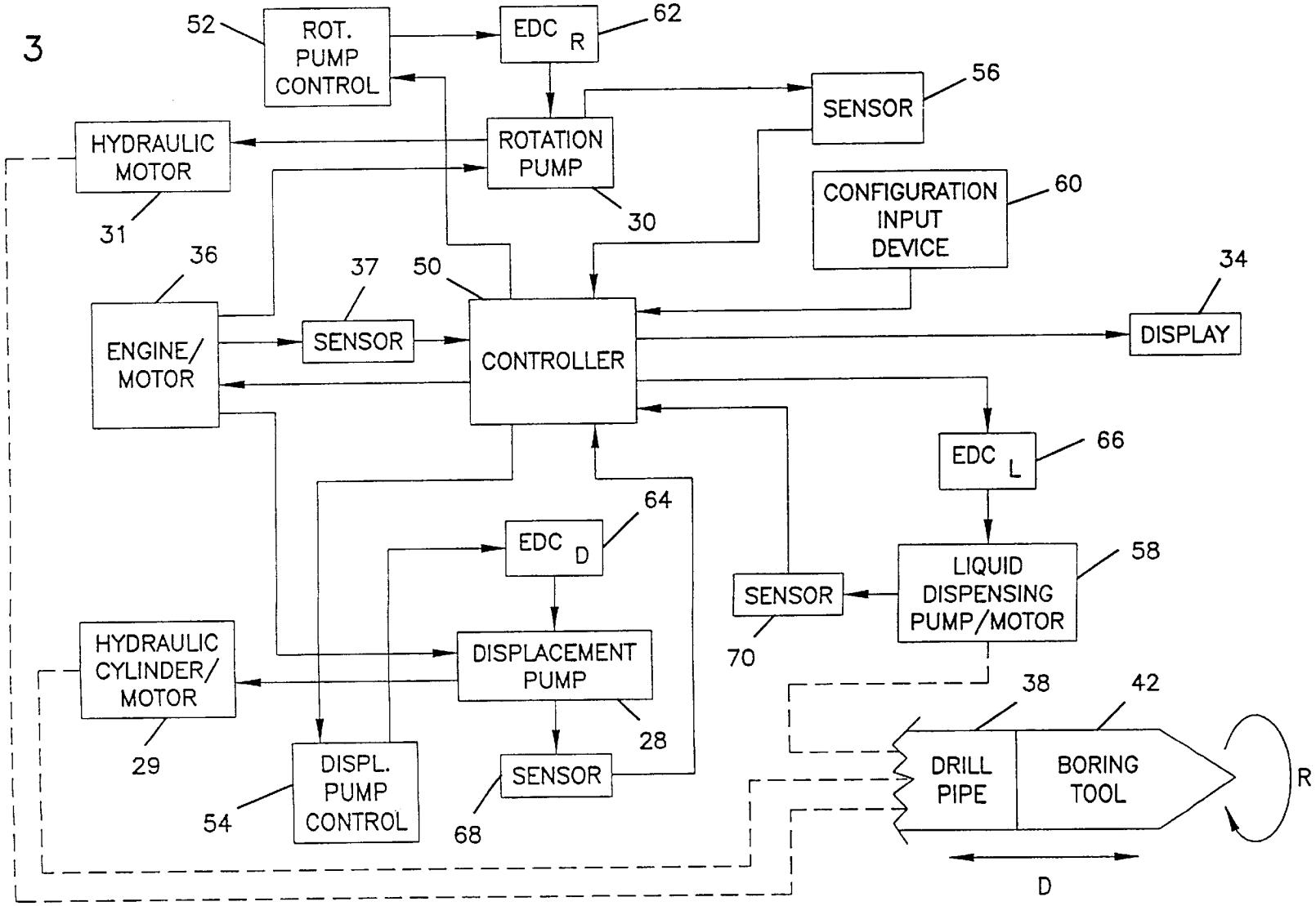
FIG. 3 is an illustration of one embodiment of a novel apparatus and method for controlling an underground boring tool.

Referring now to FIG. 3, there is illustrated another embodiment of a novel apparatus and method for controlling an underground boring machine 20 according to the present invention. Automatic modification to the operation of the displacement pump 28 and rotation pump 30 is controlled by a controller 50. A rotation pump sensor 56, coupled to the rotation pump 30 and the controller 50, provides an output signal to the controller 50 corresponding to the pressure level, or alternatively, the rotation speed of the rotation pump 30. In addition, a displacement pump sensor 68, coupled to the displacement pump 28 and the controller 50, provides an output signal to the controller 50 corresponding to the pressure level of the displacement pump 28 or, alternatively, the speed of the displacement pump 28. A rotation pump control 52 and a displacement pump control 54 provide for manual control over the gross rate at which drilling or back reaming is performed.

In accordance with a preferred mode of operation, an operator sets the rotation pump control 52 to an estimated optimum rotation setting during a drilling or back reaming operation, and modifies the setting of the displacement pump control 54 in order to change the gross rate at which the boring tool 42 is displaced along an underground path when drilling or back reaming. The rotation pump control 52 transmits a control signal to an electrical displacement control 62 ($EDC_R$) coupled to the rotation pump 30. The $EDC_R$ 62 converts the electrical control signal into a hydrostatic control signal which is transmitted to the rotation pump 30 for purposes of controlling the rotation rate of the boring tool 42.

The operator then sets the displacement pump control 54 to a setting corresponding to a preferred boring tool displacement rate. The operator may modify the setting of the displacement pump control 54 to effect gross changes in the rate at which the boring tool 42 is displaced along an underground path when drilling or back reaming. The displacement pump control 54 transmits a control signal to a second EDC 64 ($EDC_D$) coupled to the displacement pump 28. The $EDC_D$ 64 converts the electrical control signal received from the controller 64 into a hydrostatic control signal, which is then transmitted to the displacement pump 28 for purposes of controlling the displacement rate of the boring tool 42.

In accordance with one embodiment, the underground boring machine 20 includes a liquid dispensing pump/motor 58 (hereinafter referred to as a liquid dispensing pump) which communicates liquid through the pipe length 38 and boring tool 42 for purposes of providing lubrication and enhanced boring efficiency. The operator controls the liquid dispensing pump 58 to dispense liquid, preferably water or a water/mud mixture, at a preferred dispensing rate by use of an appropriate control lever or knob provided on the control panel 32 shown in FIG. 1. Alternatively, the dispensing rate of the liquid dispensing pump 58, as well as the settings of the rotation pump 30, displacement pump 28, and engine 36, may be set and controlled using a configuration input device 60, which may be a keyboard, keypad, touch sensitive screen or other such input interface device, coupled to the controller 50. The controller 50 receives the liquid dispensing setting produced by the control lever/knob provided on the control panel 32 or, alternatively, the configuration input device 60, and transmits an electrical control signal to a third EDC 66 ($EDC_L$) which, in turn, transmits a hydrostatic control signal to the liquid dispensing pump 58.

A feedback control loop provides for automatic adjustment to the rate of the displacement pump 28 and rotation pump 30 in response to varying drilling conditions. A rotation sensor 56 preferably senses the pressure of the fluid in the rotation pump 30. Under dynamically changing boring conditions, and with the settings of the rotation and displacement pump controls 52 and 54 remaining at a substantially fixed position, the pressure of the displacement pump 28 is automatically modified to compensate for drilling/back reaming load changes while the rate of boring tool rotation is maintained at a substantially constant level.

Figure 5:
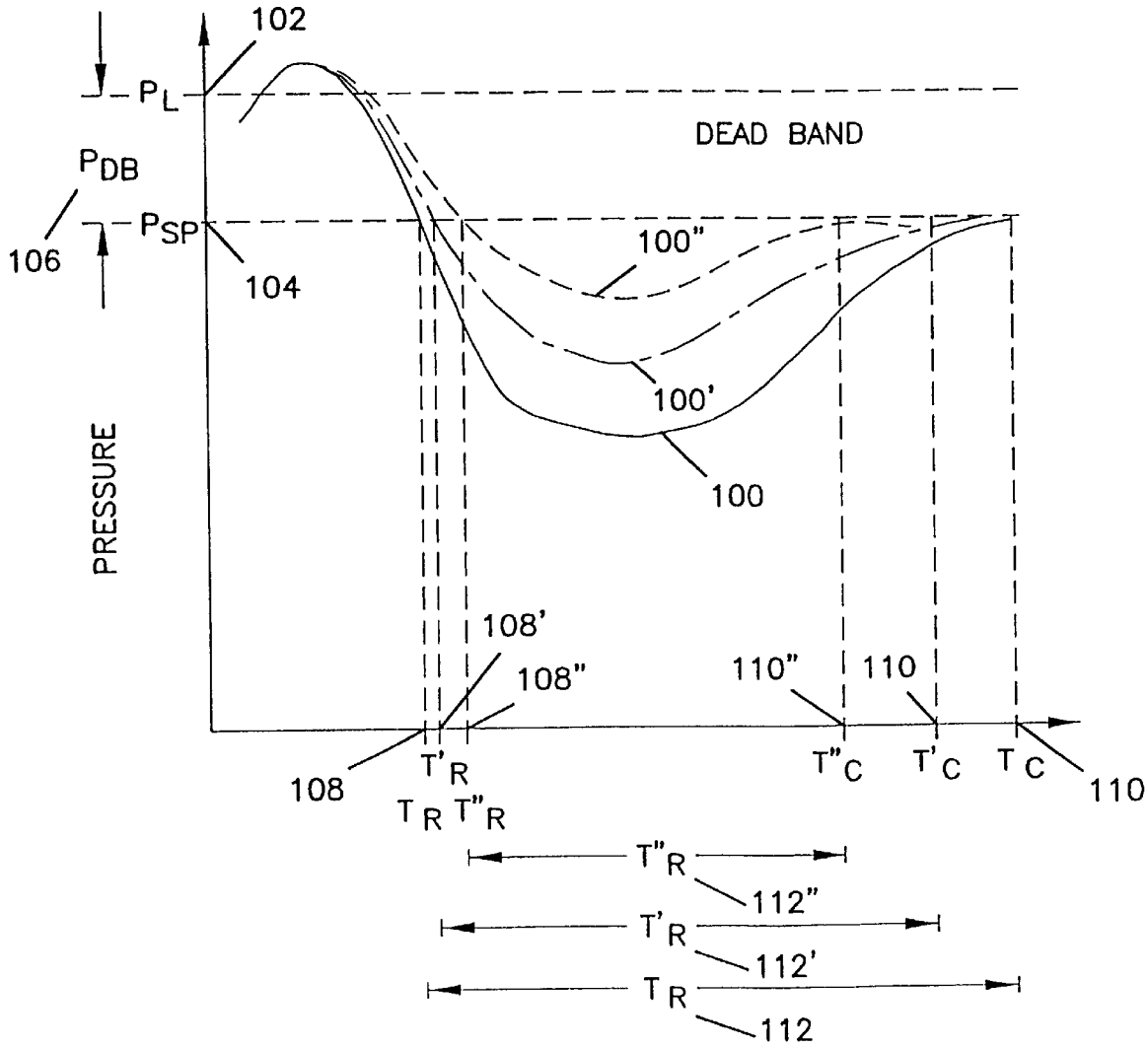
FIG. 5 is an illustration of pressure curves depicting relationships between rotation pump pressures versus time in response to changes in boring tool loading.

As illustrated in FIG. 5, a preferred set point pressure level, $P_{SP}$, and an upper acceptable pressure limit, $P_L$, for the rotation pump 30 are stored in the controller 50 or, alternatively, transmitted to the controller 50 from the configuration input device 60. It is noted that the set point pressure level, $P_{SP}$, is preferably lower than the upper acceptable pressure limit, $P_L$. When the rotation sensor 56 senses a pressure in excess of $P_L$, the controller 50 modifies the displacement pump control signal transmitted to the $EDC_D$ 64 to reduce the speed of the displacement pump 28, and thus the rate of boring tool displacement, while maintaining constant the rate of boring tool rotation.

Conversely, when the pressure detected by the rotation pump sensor 56 falls below the set point pressure level $P_{SP}$, the controller 50 alters the displacement pump control signal transmitted to the $EDC_D$ 64 so as to increase the displacement rate of the boring tool 42 in order to maximize boring efficiency at a constant boring tool rotation rate. The modified control signal produced by the controller 50, which is transmitted through the displacement pump control 54 to the $EDC_D$ 64 or, alternatively, directly to the $EDC_D$ 64 over an appropriate control line (not shown) effectively modifies the boring tool displacement rate initially established by the position of the displacement pump control 54. The rotation pump 30 is thus maintained at a substantially constant rotation rate which provides for optimized drilling efficiency.

Depending on soil and other operational conditions, the controller 50 may be unable to effect an increase in the displacement rate of the boring tool 42 sufficient to cause the pressure of the rotation pump 30 to meet or exceed the set point pressure level, $P_{SP}$. In an alternative embodiment, the controller 50 may override the rotation pump control 52 signal in response to the difference between the rotation pump pressure and the set point pressure level, $P_{SP}$, by transmitting a control signal to the rotation pump control 52 to instruct the $EDC_R$ 62 to increase the speed of the rotation pump 30 so that the rotation pump pressure increases to the set point pressure level $P_{SP}$. Alternatively, a control line (not shown) between the controller 50 and the $EDC_R$ 62 may be provided for directly transmitting the control signal to the $EDC_R$ 62.

In accordance with another embodiment, the operator may set an upper acceptable pressure limit, $P_{DL}$, for the displacement pump 28. The displacement pump sensor 68 preferably monitors the pressure of the displacement pump 28 and transmits a pressure signal to the controller 50. When the controller 50 detects that the displacement pump pressure increases above the upper acceptable pressure limit, $P_{DL}$, the controller 50 transmits a control signal to the displacement pump control 54, or, alternatively, directly to the $EDC_D$ 64, to control $EDC_D$ 64 so as to reduce the displacement rate of the boring tool 42. A reduction in the displacement rate of the boring tool 42 results in the displacement pump pressure falling to or below the upper acceptable pressure limit, $P_{DL}$. Thus, the controller 50 may override or modify the displacement pump control 54 signal in order to maintain the displacement pump pressure at a pre-established level.

In accordance with another embodiment, the controller 50 monitors the performance of the engine/motor 36 using a sensing signal generated by a motor sensor 37 that senses a selected motor parameter indicative of power loading on the motor. The performance of the engine/motor 36 may preferably be determined by measuring its crankshaft rotation speed in revolutions per minute (r.p.m.), the rate of fuel injected in order to maintain a certain crankshaft r.p.m., exhaust temperature, turbo r.p.m. or the like. An increased drilling load increases the load on the motor, thereby effecting a change in motor performance. Depending on the configuration of the engine/motor 36, the increased load may result in a reduction in the crankshaft r.p.m., an increased fuel injection rate, a higher exhaust temperature, a reduction in turbo r.p.m, or the like. The controller 50 may preferably be programmed to reduce the boring tool displacement rate upon detecting degradation in the performance of the engine/motor 36 and to reinstate the predetermined boring tool displacement rate upon recovery of engine/motor operating parameters to within an acceptable range.

In yet another embodiment, automatic control of the liquid dispensing pump 58 is provided by the controller 50. Liquid is pumped through the drill pipe 38 and boring tool 42 or back reamer (not shown) so as to flow into the borehole during drilling and reaming operations. The liquid flows out from the boring tool 42, up through the borehole, and emerges at the ground surface. The flow of liquid washes cuttings and other debris away from the boring tool 42 or reamer, thereby permitting the boring tool 42 or reamer to operate unimpeded by such debris. The rate at which liquid is pumped into the borehole by the liquid dispensing pump 58 is typically dependent on the drilling rate of the boring machine 20. If the boring tool 42 or reamer is displaced at a relatively high rate through the ground, for example, the controller so transmits a signal to the $EDC_L$ 66 to increase the volume of liquid dispensed by the liquid dispensing pump 58.

The controller 50 may optimize the process of dispensing liquid into the borehole by monitoring the rate of boring tool or back reamer displacement and computing the material removal rate as a result of such displacement. For example, the rate of material removal from the borehole, measured in volume per unit time, can be estimated by multiplying the displacement rate of the boring tool 42 by the cross-sectional area of the borehole produced by the boring tool 42 as it advances through the ground. The controller 50 calculates the estimated rate of material removed from the borehole and the estimated flow rate of liquid to be dispensed through the liquid dispensing pump 58 in order to accommodate the calculated material removal rate. The liquid dispensing sensor 70 detects the actual flow rate of liquid through the liquid dispensing pump 58 and transmits the actual flow rate information to the controller 50. The controller 50 then compares the calculated liquid flow rate with the actual liquid flow rate. In response to a difference therebetween, the controller 50 modifies the control signal transmitted to the $EDC_L$ 66 to equilibrate the actual and calculated flow rates to within an acceptable tolerance range.

The controller 50 may also optimize the process of dispensing liquid into the borehole for a back reaming operation. The rate of material removal in the back reaming operation, measured in volume per unit time, can be estimated by multiplying the displacement rate of the boring tool 42 by the cross-sectional area of material being removed by the reamer. The cross-sectional area of material being removed may be estimated by subtracting the cross-sectional area of the reamed hole produced by the reamer advancing through the ground from the cross-sectional area of the borehole produced in the prior drilling operation by the boring tool 42. In a procedure similar to that discussed in connection with the drilling operation, the controller 50 calculates the estimated rate of material removed from the reamed hole and the estimated flow rate of liquid to be dispensed through the liquid dispensing pump 58 in order to accommodate the calculated material removal rate. The liquid dispensing sensor 70 detects the actual flow rate of liquid through the liquid dispensing pump 58 and transmits the actual flow rate information to the controller 50. The controller 50 then compares the calculated liquid flow rate with the actual liquid flow rate. In response to a difference therebetween, the controller 50 modifies the control signal transmitted to the $EDC_L$ 66 to equilibrate the actual and calculated flow rates to within an acceptable tolerance range.

In accordance with an alternative embodiment, the controller 50 may be programmed to detect simultaneous conditions of high displacement pressure and low rotation pressure, detected by sensors 68 and 56 respectively. Under these conditions of pressure, there is an increased probability that the boring tool 42 is close to seizing in the borehole. This anamolous condition is detected when the pressure of the displacement pump 28 detected by sensor 68 exceeds a first predetermined level, $P_{DS}$, and when the pressure of the rotation pump 30 detected by sensor 56 falls below a second predetermined level, $P_{RS}$. Upon detecting these pressure conditions simultaneously, the controller 50 may increase the liquid flow rate by transmitting an appropriate signal to the liquid dispensing $EDC_L$ 66 and thus prevent the boring tool 42 from seizing. Alternatively, the controller 50 may be programmed to reduce the displacement rate of the boring tool 42 when the conditions of high displacement pump pressure and low rotation pump pressure exist simultaneously, as determined in the manner described above.

As discussed previously, the configuration input device 60 is provided as an interface between the operator and the controller 50. The operator may use the configuration input device 60 to transfer parameters to the controller 50 including, but not limited to, set points and upper limits for the pressure levels in the rotation pump 30, the displacement pump 28, and the liquid dispensing pump 58, a pre-established boring tool rotation speed, a pre-established boring tool displacement rate, and a pre-established liquid dispensing rate. A display device 34 is also provided as an interface between the controller 50 and the operator for visually communicating information to the operator concerning the various parameter settings operated on by the controller 50, actual operating levels, pressures, and other parameters. The display device 34 may be a liquid crystal display screen, a cathode ray tube, a calculator-like array of seven segment displays, an array of analog dials, or the like.

Figure 4:
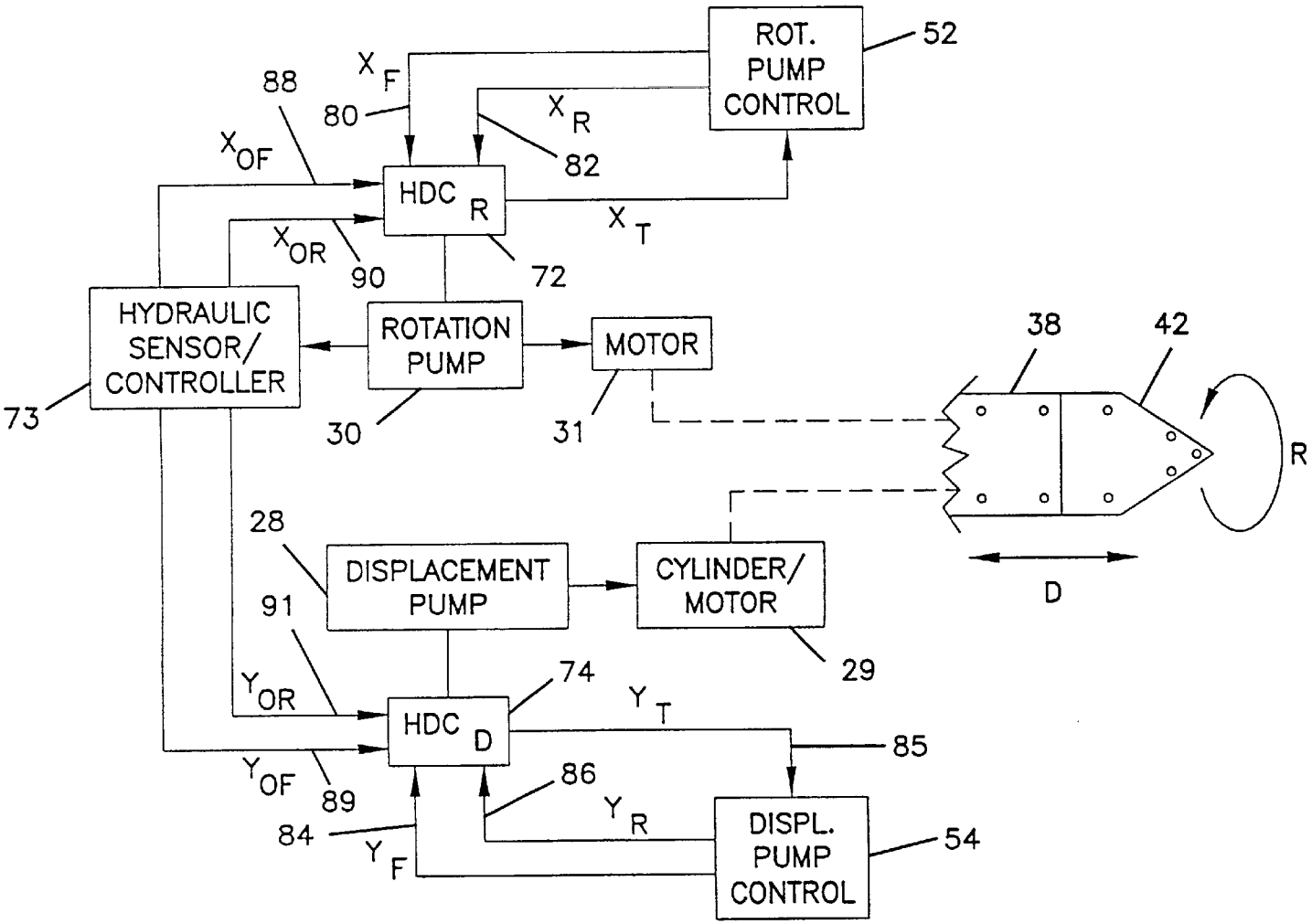
FIG. 4 is another embodiment of an apparatus and method for controlling an underground boring tool.

In FIG. 4, there is illustrated an alternative embodiment of the present invention, in which control of the displacement pump 28 is provided through hydraulic control signals, rather than electrical control signals employed in the embodiments described hereinabove. In accordance with a preferred mode of operation, the operator sets the rotation pump control 52 to an estimated optimum rotation setting for a drilling or reaming operation. The rotation pump control 52 transmits a control signal to a hydraulic displacement control ($HDC_R$) 72 which, in turn, transmits a hydraulic control signal to the rotation pump 30 for purposes of controlling the rotation rate of the boring tool 42.

Various types of hydraulic displacement controllers (HDCs) use hydraulic pilot signals for effecting forward and reverse control of the pump servo. A pilot signal is normally controlled through a pilot control valve by modulating a charge pressure signal typically between 0 and 800 pounds-per-square inch (psi). $HDC_R$ 72, in response to the operator changing the setting of the rotation pump control 52, produces corresponding changes to the forward pilot signal $X_F$ 80 and the reverse pilot signal $X_R$ 82, thus altering the rate of the rotation pump 30. Line $X_T$ 81 is a return line from $HDC_R$ 72 to the rotation pump control 52. Similarly, in response to the operator changing the setting of the displacement pump control 54, the displacement pump control 54 correspondingly alters the forward pilot signal $Y_F$ 84 and the reverse pilot signal $Y_R$ 86 of $HDC_D$ 74, which controls the displacement pump 28, thus altering the displacement rate. Line $Y_T$ 85 is a return line from $HDC_D$ 74 to the displacement pump control 54.

The hydraulic sensor/controller 73 senses the pressure of the rotation pump 30 or, alternatively, the rotation speed of the rotation pump 30 by monitoring the flow rate through an orifice to measure rotation, and is operable to transmit hydraulic override signals $X_{OF}$ 88 and $X_{OR}$ 90 to the $HDC_R$ 72, and hydraulic override signals $Y_{OF}$ 89 and $Y_{OR}$ 91 to the $HDC_D$ 74. When the hydraulic sensor/controller 73 senses that the pressure of the rotation pump 30 has exceeded the upper acceptable pressure limit, $P_L$, override signals $Y_{OF}$ 89 and $Y_{OR}$ 91 are transmitted to the $HDC_D$ 74 in order to appropriately reduce the boring tool displacement rate while maintaining the rotation of the boring tool at a substantially constant rate. Once the pressure of the rotation pump 30 has recovered to an acceptable level, the hydraulic sensor/controller 73 instructs $HDC_D$ 74 to increase the displacement rate.

Figure 6:
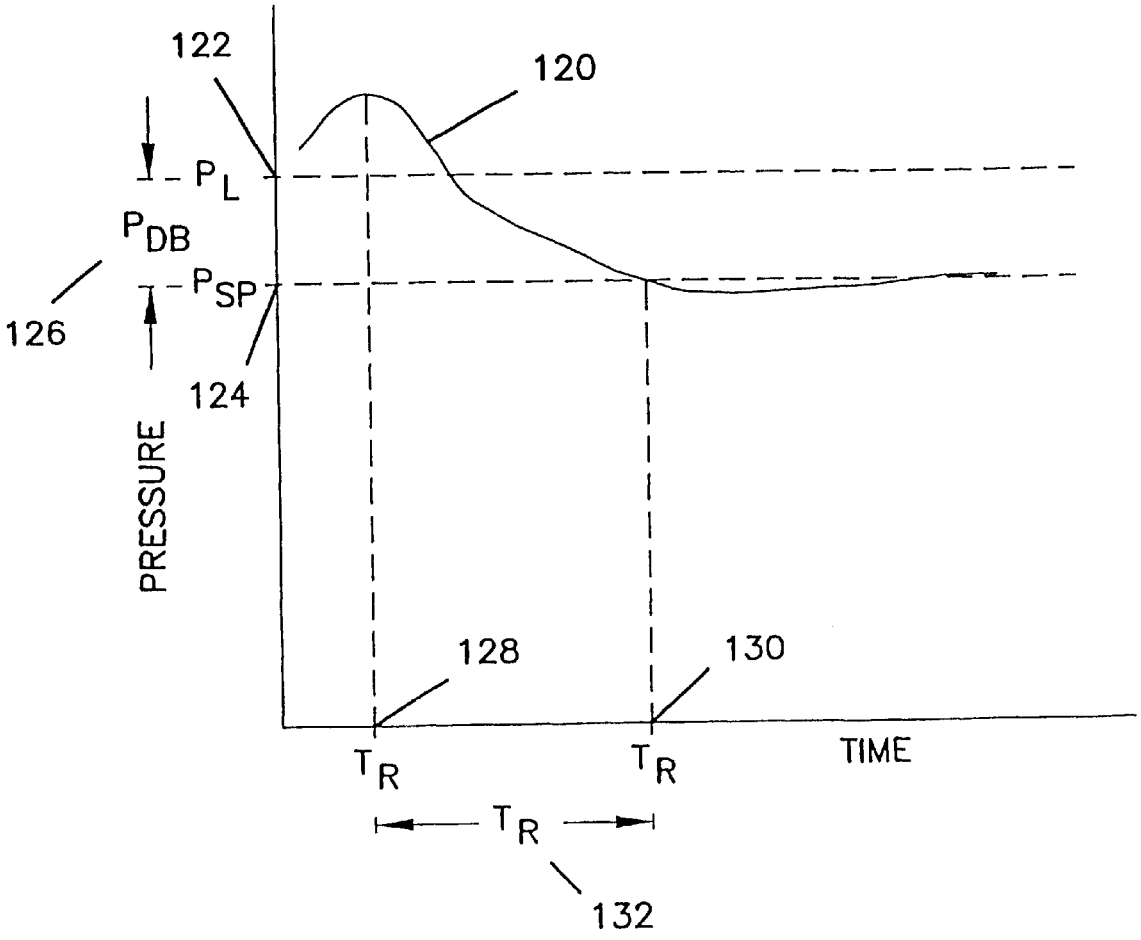
FIG. 6 is another illustration of a pressure curve depicting a relationship between rotation pump pressure versus time in response to changes in boring tool loading.

FIGS. 5 and 6 illustrate in graphical form two operating pressure curves 100 and 120 respectively plotted against time for the rotation pump 30. The pressure curves 100 and 120 illustrate the responsiveness of the boring machine control system 20 when automatically correcting for variations in rotation pump loading.

In FIG. 5, the line $P_{SP}$ 104 corresponds to the set point pressure level of the rotation pump 30, and the line $P_L$ 102 corresponds to the upper acceptable pressure limit which is tolerated before a pressure correction procedure is activated. The dead band, $P_{DB}$ 106, is a range of pressure values above $P_{SP}$ for which the controller 50 takes no corrective action. When the rotation pump pressure curve 100 rises above $P_L$ 102, the controller 50 initiates a pressure correction procedure. The controller 50 reduces the pressure 100 preferably by reducing the displacement rate of the displacement pump 28 as described hereinabove. The pressure 100 then drops, reaching a value of $P_{SP}$ at a time $T_I$ 108.

When the controller 50 senses that the pressure 100 has fallen to a level below $P_{SP}$, the controller 50 transmits a control signal to the displacement pump 28 to increase the boring tool displacement rate. Due to mechanical and system control inertia, the pressure 100 typically undershoots $P_{SP}$ 104, reaches a minima, and then increasing to return to a value approximating $P_{SP}$ 104 at a time $T_C$ 110. The total time over which the rotation pump pressure may be considered to be below $P_{SP}$ is indicated as $T_R$ 112, where $T_R=T_C-T_I$. The total time $T_C$ represents the response time required by the boring machine 20 to sense and correct for variations in rotation pump pressure beyond a pre-established pressure range. Boring efficiency may be optimized by maintaining the rotation pump pressure close to $P_{SP}$ during periods in which the boring tool 42 meets, with varying resistance. As such, it is preferable to control the boring machine 20 so that the duration of time $T_R$ 112 during which the rotation pump pressure is below $P_{SP}$ 104 is minimal, and that the amount by which the pressure 100 undershoots $P_{SP}$ 104 is also minimal.

The curve 100' illustrates the behavior of the rotation pump pressure when the initial rate of pressure reduction is less rapid than the rate of reduction of pressure curve 100. It can be seen that the pressure 100' drops below $P_{SP}$ at a time $T_I'$ 108' which is later in time than $T_I$. However, the pressure 100' does not undershoot $P_{SP}$ as much as does pressure curve 100, and increases to approximately $P_{SP}$ at a time $T_C'$ 110' which is earlier in time than $T_C$ 110. Consequently, the total time, $T_R'$ 112' during which the pressure 100' is below $P_{SP}$ 104 is less than the time $T_R$ 112 associated with pressure curve 100.

Curve 100" illustrates the behavior of the rotation pump pressure when the initial rate of pressure reduction is less rapid than the rate of reduction of pressure curve 100'. For this third case, the pressure 100" does not undershoot $P_{SP}$ as much as does curve 100', and increases to approximately $P_{SP}$ at a time $T_C$" 110" which is earlier in time than $T_C'$ 110'. Consequently, the total time, $T_R$" 112", during which the pressure 100" is below $P_{SP}$ 104 is less than the time $T_R'$ 112' associated with curve 100' or the time $T_R$ associated with curve 100.

The temporal dependence of the pressure 120 during an alternative pressure reducing procedure implemented by the controller 50 is illustrated in FIG. 6. The pressure 120 is reduced at time $T_D$ 128 after the controller 50 detects that the rotation pump pressure has reached a value in excess of $P_L$ 124 by reducing the boring tool displacement rate accordingly. Initially, the pressure reduction is rapid. The controller 50 monitors the pressure 120 while it drops, and also monitors the time derivative of the pressure (the rate of pressure drop). If the controller 50 determines that the current rate of pressure drop is higher than a predetermined rate of pressure drop, $R_{PD}$, and further determines that the pressure is therefore likely to undershoot $P_{SP}$ 122, the controller 50 accordingly reduces the rate of change in the boring tool displacement rate. The reduction in the change of displacement rate results in a reduction in the rate of pressure drop.

The controller 50 continues to monitor the rotation pump pressure and the rate of pressure drop, as well as to continue reducing the boring tool displacement rate. By continually monitoring the pressure and the rate of pressure drop, and adjusting the displacement rate according to the rate of pressure drop, the controller 50 is able to adjust the rotation pump pressure 120 so that the pressure 120 approaches $P_{SP}$ 122 without experiencing the large undershoot shown in FIG. 5. Moreover, the total time $T_R$ 132 taken to reach an acceptable pressure level may be less than the settling times shown in FIG. 5 (i.e., $T_R$ 112, $T_R'$ 112', and $T_R''$ 112"). In addition, the pressure does not fall significantly below $P_{SP}$ 120 between the times $T_D$ 128 and $T_C$ 130, and therefore, the efficiency of the boring operation is optimized during the time $T_R$ 132 of adjustment.

It can be appreciated that other control methodologies may be employed. By way of example, the controller 50 may compute and operate on the first and second time derivatives of rotation pump pressure in order to more accurately predict pressure behavior under conditions of changing boring tool displacement rates.

Figure 11:
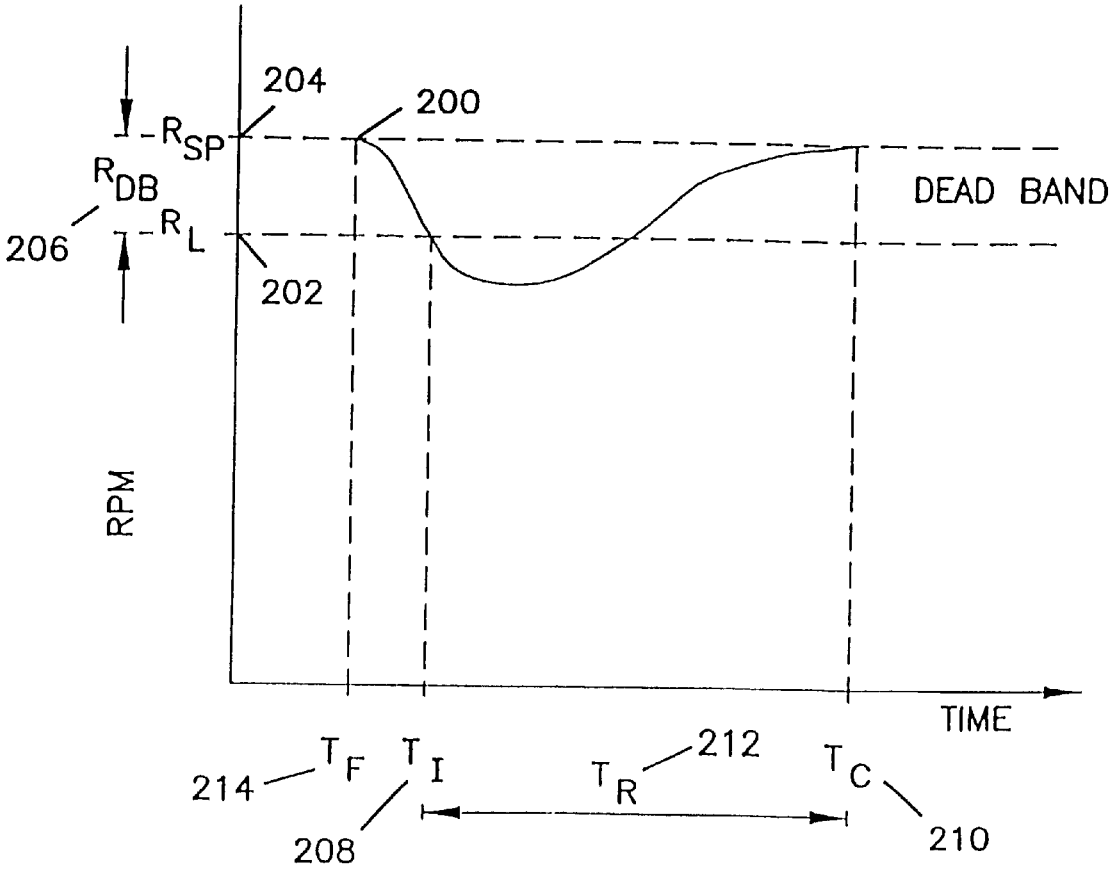
FIG. 11 is another illustration of a control curve depicting a relationship between crankshaft r.p.m. versus time in response to changes in boring tool loading.

FIG. 11 illustrates in graphical form a curve 200 corresponding to an operating parameter of the engine/motor 36 plotted against time. The curve 200 illustrates the responsiveness of the boring machine control system 20 when automatically correcting for variations in engine/motor 36 loading. FIG. 11 illustrates a case in which the engine crankshaft r.p.m. is monitored, although it is understood that other parameters may be used to monitor the performance of the engine/motor 36, as discussed hereinabove.

The crankshaft r.p.m. 200 initially is close to a set point r.p.m. level, $R_{SP}$ 204. The crankshaft r.p.m. 200 begins to fall at a time $T_F$ 214 due to increased engine loading caused by changing drilling conditions. The dead band, $R_{DB}$ 206, is a range of crankshaft r.p.m. values for which the controller 50 takes no corrective action. At a time $T_I$ 208, the controller 50 detects that the crankshaft r.p.m. 200 has reached a value below a lower limit $R_L$ 202 and, in response, initiates a pressure correction procedure. The controller 50 increases the crankshaft r.p.m. 200 preferably by reducing the displacement rate of the displacement pump 28 as described hereinabove. The crankshaft r.p.m. 200 then increases, reaching a value approximating $R_{SP}$ at a time $T_C$ 210. It is understood that more complex correction procedures, including those discussed hereinabove in connection with correcting the rotation pump pressure, may be implemented in accordance with this embodiment for purposes of monitoring and correcting an operating parameter of the engine/motor 35.

Figure 7:
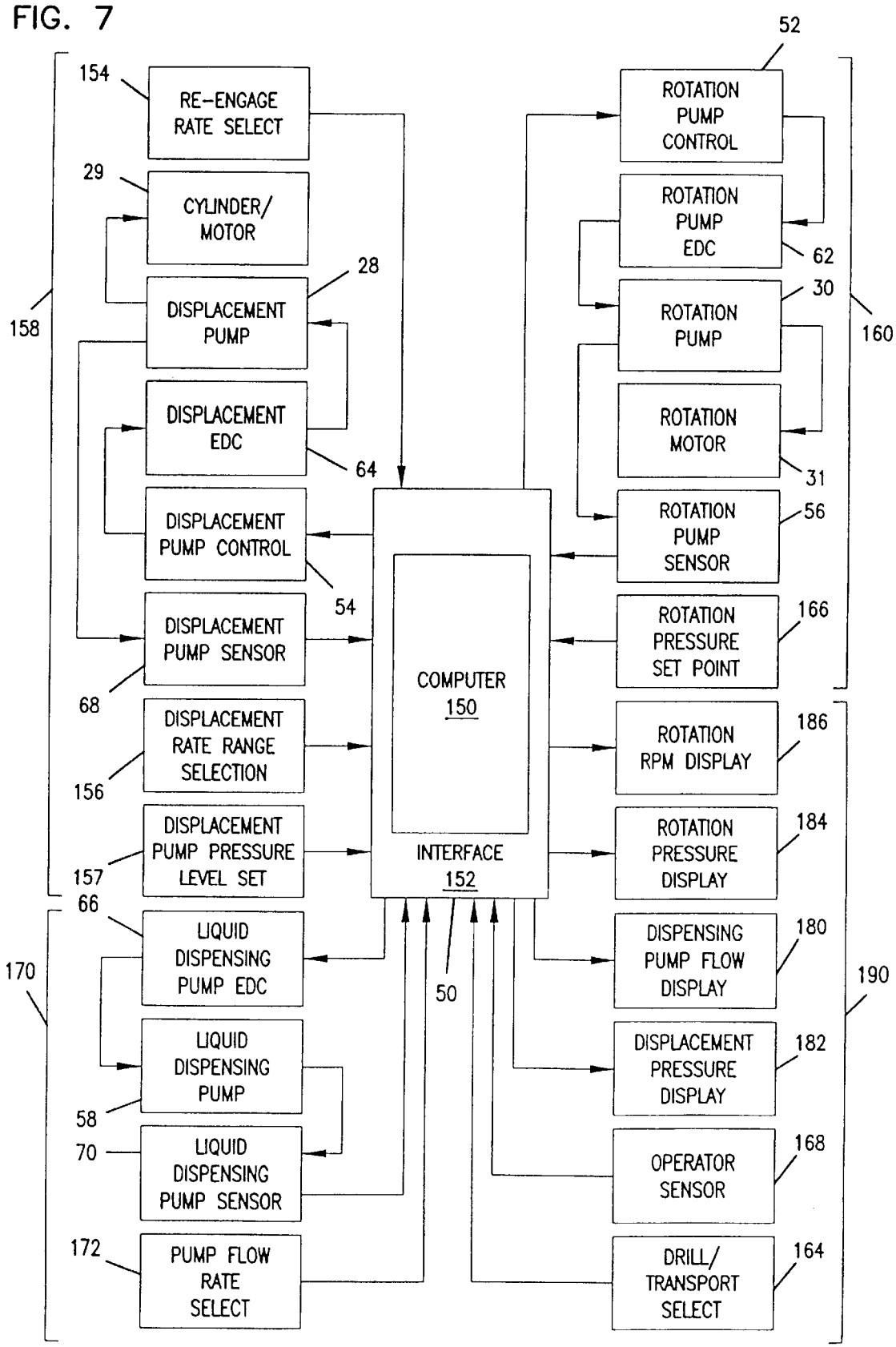
FIG. 7 is an illustration of various inputs and outputs to a controller incorporated into a novel apparatus for controlling an underground boring tool.

In FIG. 7, there is illustrated an embodiment of the controller 50 for controlling the underground boring machine 20 showing a plurality of inputs and outputs connected to the controller 50. Central to the operation of the controller 50 is a computer 150. The computer 150 communicates with the various components of the boring machine 20 when controlling and optimizing boring machine operations. Sensor information is acquired from the various sensors that monitor boring machine operations through an input/output (I/O) interface 152. The computer 150 transmits and receives signals and other information through the interface 152 to control various actuators, pumps, and motors, and to communicate current operating information to the operator.

The Displacement Control Group 158 includes various sensors and actuators employed to monitor and control the displacement of the boring tool 42. The displacement pump control 54, selectively actuatable by the operator, transmits a control signal to the displacement $EDC_D$ 64, which, in turn, communicates a control signal to the displacement pump 28. The displacement pump 28, in turn, activates the displacement cylinder/motor 29 in accordance with the selected displacement rate. In response to sensor signals received by the controller 50, as discussed hereinabove with regard to automatic control of the displacement rate, the controller 50 may transmit an output signal to the displacement pump control 52 to control the displacement rate. The controller output signal may override the value of displacement rate selected by the operator.

A re-engagement rate selection switch 154 allows the operator to select the response rate of the control system when reacting to increasing rotation pump pressures beyond a pre-established pressure limit. As is further discussed with respect to FIGS. 5 and 6, the response rate preferably varies between 0.1 seconds and 0.5 seconds. For example, an operator may select a response rate of 0.3 seconds. When the rotation pump sensor 56 senses a pump pressure in excess of the pre-established pressure limit, such as 6,000 p.s.i. for example, the control system will effect a reduction in the displacement rate of the boring tool 42 sufficient to cause a reduction in the rotation pump pressure to a pre-established set-point within 0.3 seconds, thus allowing the boring operation to continue optimally and safely with only a minimal time delay.

A displacement rate range selection switch 156 is provided for the operator to select the range of displacement rates over which the displacement pump control 52 is operable when adjusting the displacement rate of the boring tool 42. This switch 156 advantageously provides the operator with extensive manual control over the boring tool displacement rate. For example, the displacement rate range selection switch 156 may have two settings, corresponding to course adjustment and fine adjustment. For a total displacement rate range of 0–150 feet per minute, selection of the course adjustment setting may permit the operator to select the displacement rate over the full range. The displacement pump control 54 preferably includes a handle which the operator rotates to select a displacement rate. Thus, full rotation of the handle while in the course adjustment setting will allow the operator to control the displacement rate over the full range of 0–150 feet per minute. Selection of the fine adjustment setting will allow the operator to vary the displacement range over some fraction, for example 10%, of the full displacement rate range. Thus, full rotation of the handle on the displacement pump control 54 while in the fine adjustment setting allows the operator to adjust the displacement range by 15 feet per minute in this example.

In accordance with a preferred operating procedure using the displacement rate range selection switch 156, the operator initially selects a preferred displacement rate by rotating the handle of the displacement pump control 52 to a position corresponding to the desired displacement rate. During the course of a drilling procedure, the operator may need to vary the displacement rate manually. If the operator determines that the likely variations in displacement rate are within the fine adjustment range, such as by approximately 10% or 15 feet per minute for example, the operator may select the fine adjustment setting using the displacement rate range selection switch 156, and may therefore alter the displacement rate from that originally selected by ±7.5 feet per minute. In an alternative approach to providing fine manual displacement rate control, the displacement pump control 54 is provided with two handles, one for course rate control and the other for fine rate control.

The displacement pump sensor 68 measures one or more operating parameters of the displacement pump 28 which may be of interest. These parameters may include, but are not limited to, the displacement rate, the displacement pump pressure, and the temperature of the displacement pump fluid.

The displacement pump pressure level setting device 157 is used for inputting a displacement pump pressure level to the controller 50. The displacement pump pressure level may be used by the controller 50 for determining whether the displacement pump is operating close to a desired level, as described hereinabove. The displacement pump pressure level setting device 157 may be included as part of the configuration parameter input device 60.

The Rotation Control Group 160 includes various sensors and actuators employed to monitor and control the rotation of the boring tool 42. The Rotation Control Group 160 includes the rotation pump control 52 which is actuatable by the operator and transmits a control signal, corresponding to a selected rotation pump rate, to the rotation pump rotation pump $EDC_R$ 62. In response, the $EDC_R$ 62 transmits a control signal to the rotation pump 30, which, in turn, controls the rotation of the rotation motor 31. In response to sensor signals received by the controller 50, as discussed hereinabove with regard to automatic control of the displacement rate, the controller 50 transmits an output signal to the rotation pump control 54 to control the rotation rate. The controller signal may override the value of the rotation rate selected by the operator. The rotation pump sensor 56 senses the pressure of hydraulic fluid in the rotation pump 30 and transmits a signal corresponding to the sensed pressure to the controller 50. Alternatively, the rotation pump sensor 56 may sense the rotation rate, and transmit a rotation rate signal to the controller 50.

A rotation pump pressure set-point input 166 is transmitted to the controller 50 from the configuration input device 60. In accordance with one embodiment, the rotation pump pressure set-point preferably ranges between 1000 psi to 6000 psi.

The Liquid Dispensing Pump Flow Control Group 170 includes a pump flow rate select switch 172 for selecting the mode of liquid flow control, including a variable mode, an automatic mode, and a full flow mode. An "off" switch setting of the flow rate selection switch disables the liquid dispensing pump 58. The flow rate select switch 172 may be incorporated as part of the configuration input device 60 or may be a discrete switch located on the control panel 32. In the variable mode of operation, the rate of liquid flow is controlled by the operator, using a control located on the liquid dispensing pump $EDC_L$ 66 or, alternatively, the parameter input device 60. In the full flow mode of operation, the liquid is pumped at a maximum rate. In the automatic mode of operation, the controller 50 controls the rate at which the liquid is pumped according to drilling conditions as discussed previously hereinabove.

Also provided is a liquid sensor 70 which produces a signal corresponding to the pressure of the liquid or, alternatively, some other parameter of interest such as flow rate, to the controller 50. In response to the signals produced by switch 172 and liquid sensor 70, in addition to other factors as discussed hereinabove regarding the rate of material removal during the boring/reaming operation, the controller 50 transmits a control signal to the liquid dispensing pump $EDC_L$ 66 which, in turn, transmits a control signal to the liquid dispensing pump 58. Alternatively, the liquid dispensing pump $ECD_L$ 66 may be provided with a control device, such as a handle or knob, which provides control abilities to the operator for controlling the flow rate of the liquid.

Various other input display devices are shown in the Miscellaneous Control Group 190. The controller 50 is preferably coupled to an operator sensor 168 which detects the presence of an operator at or near a designated control location. This sensor may include, for example, a key switch, a switch detecting the operator's presence on a seat, or a kill-switch connected to the operator's wrist. The signal produced by sensor 168 may be used by the controller 50 to prevent accidental activation of any of the EDCs and to maintain safe operating conditions. A drill/transport selection switch 164, which may be included as part of the configuration input device 60, permits selection between transport and drilling modes of operation.

The display device 34 may be used to display information corresponding to the data input to the controller 50 through the configuration input device 60. The display device 34 may also display various operational parameters of the boring machine 20 during a drilling operation, including a liquid flow rate indication 180, a displacement pressure indication 182, a rotation pump pressure indication 184, and a pump or boring tool rotation rate 186 indication, for example.

Figure 8:
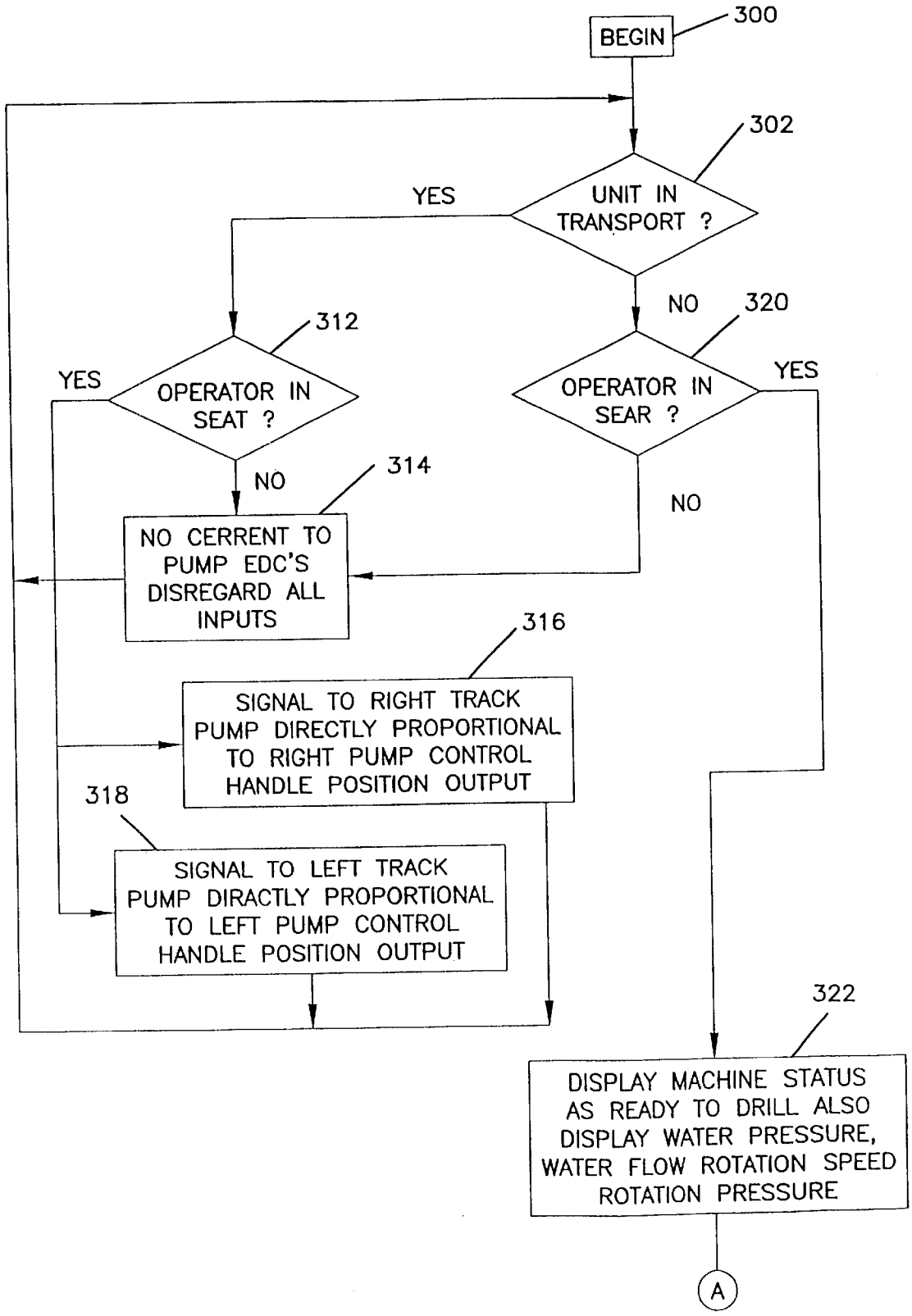
FIGS. 8–10 illustrate in flow diagram for various steps for effecting a novel method for controlling an underground boring tool.
Figure 9:
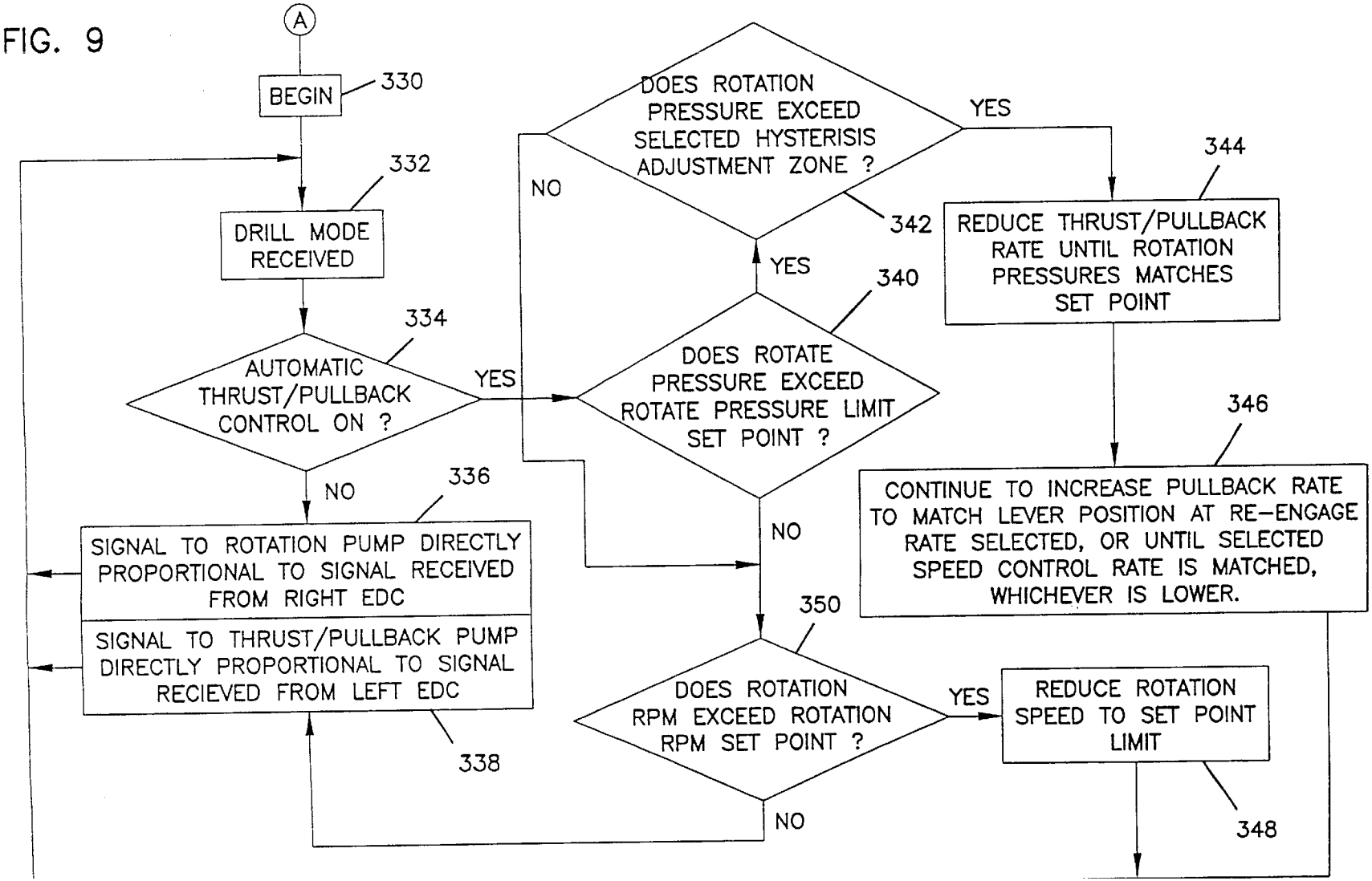
Figure 10:
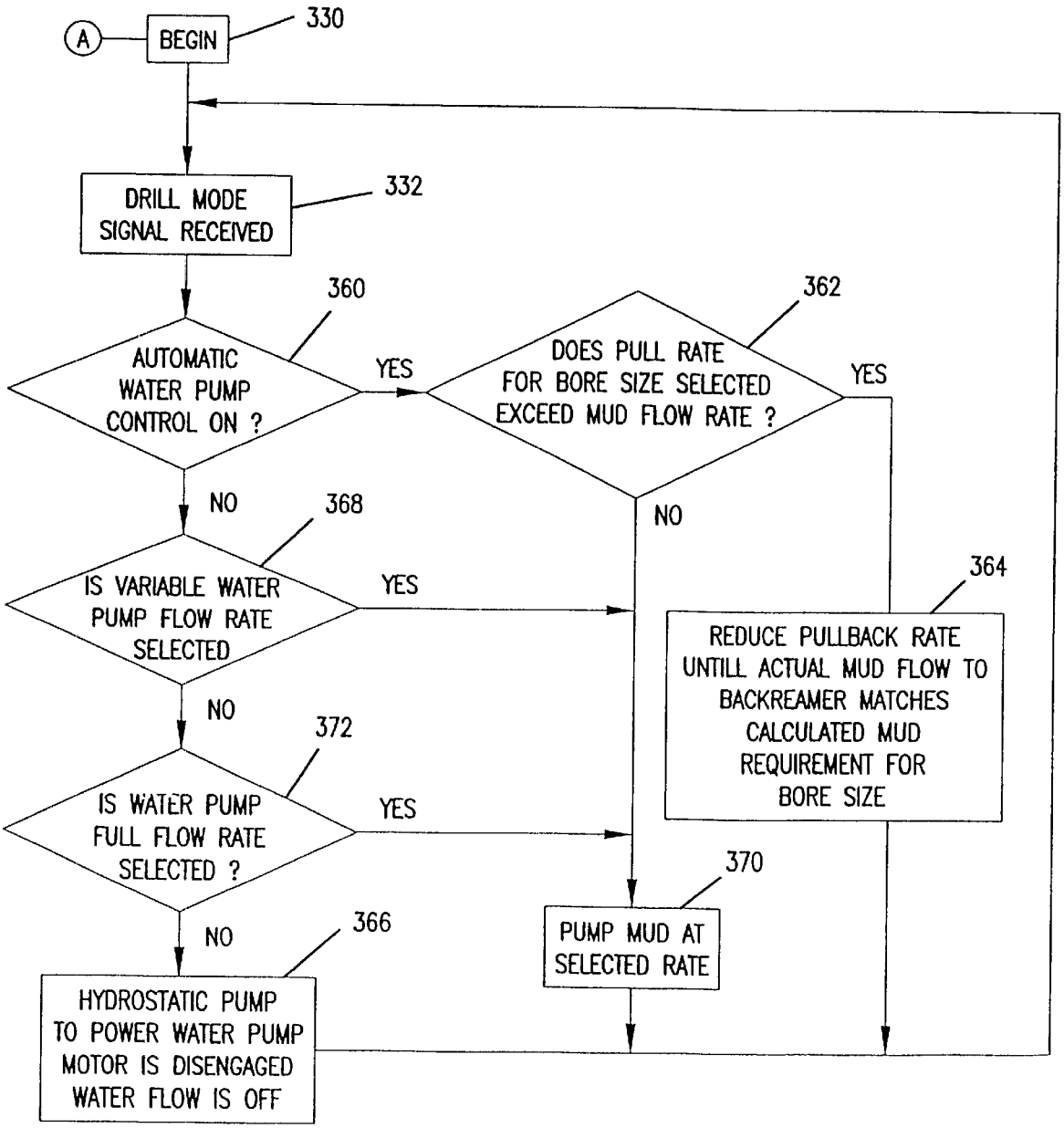

Control logic for operating the boring machine 20 in accordance with the present invention is illustrated in FIGS. 8–10. The logic sequence illustrated is applicable to a self-propelled, track-driven boring machine 20 which is propelled by left and right track drives. The logic sequence illustrated in FIG. 8 is directed to ensuring that the underground boring machine 20 is not moving prior to commencement of a drilling operation. The controller 50 first determines, at step 302, whether the boring machine 20 is in the transport mode or the drilling mode. If, at step 302, the controller 50 determines that a transport mode has been selected, and, at step 312, also determines that the operator is not present, for example by monitoring the operator sensor 168, the controller 50 discontinues the flow of control current to the EDCs and, at step 314, ignores all or selected input signals. If the controller 50 determines, at step 312, that an operator is present, the controller 50 enables, at steps 316 and 318, control of the pumps driving the left and right tracks of the boring machine 20.

If, at step 304, the controller 50 determines that the transport mode has not been selected, the controller 50 determines, at step 320, whether an operator is present, for example by monitoring the operator sensor 168. If no operator is present, the controller 50 discontinues the flow of control current to the EDCs and ignores all or selected input signals at step 314. Subsequent logic steps are executed under the assumption that the boring machine 20 is in the drill mode of operation with an operator present, as is indicated at step 322. Status information of various system components and operational parameters are preferably displayed on the display device 34.

The logic sequence illustrated in FIG. 9 is directed to control of the boring tool displacement rate. The logic sequence shown in FIG. 9 commences at step 330, following the sequence shown in FIG. 8. After receiving a drill signal, at step 332, the controller 50 determines whether the automatic displacement control mode of operation has been selected, as is tested at step 334. If, at step 336, the automatic control mode has not been selected, the controller 50 sets the control signal to the rotation pump 30 to be proportional to the signal received from the rotation pump control 52, as may be set by a handle. The controller 50, at step 338, also sets a control signal to the displacement pump 28 that is proportional to the signal received from the displacement pump control 54, as may be set by a handle. The boring machine 20 continues the drilling operation in response to the control signals received from the operator, until the automatic displacement control mode:is initiated at step 334.

When the automatic displacement control mode of operation is selected, at step 334, the controller 50 determines whether the pressure of the rotation pump 30 exceeds than the rotation pump pressure limit $P_L$, at step 340. If the pressure does not exceed $P_L$, the controller 50 determines whether the rotation rate exceeds a predetermined limit, at step 342. If the rotation rate does not exceed the predetermined limit, the controller 50 sets the control signal to the rotation pump 30 to be proportional to the signal received from the rotation pump control 52, as may be set by a handle. The controller 50, at step 338, also sets a control signal to the displacement pump 28 that is proportional to the signal received from the displacement pump control 54, as may be set by a handle. If, at step 350, the controller 50 determines that the rotation rate exceeds a predetermined limit, the rotation rate is reduced, at step 348, thus overriding the rotation pump control setting established by the operator.

If, at step 340, the controller 50 determines that the rotation pump pressure exceeds $P_L$, the controller 50 then determines whether the pressure falls outside of a preselected hysteresis adjustment zone, or dead band, at step 340. If the pressure is determined not to exceed the preselected hysteresis adjustment zone, as is tested at step 342, the controller 50 returns to step 350 and continues to monitor the rotation rate.

If it is determined, at step 342, that the rotation pump pressure falls outside of the preselected hysteresis zone, the controller 50, at step 344, reduces the boring tool displacement rate until the rotation pump pressure matches the set pressure point in accordance with the optimization methodology discussed previously with respect to FIGS. 5 and 6, thereby effectively overriding the setting of the displacement control 54 established by the operator. Alternatively, at step 344, the boring tool displacement rate is reduced until the rotation pressure matches a pre-established rotation pressure. At step 346, the controller 50 increases the displacement rate until either the rotation pump 30 pressure set point or the selected displacement rate is reached, whichever is lower. The controller 50 then returns to step 332 and continues monitoring for the occurrence of an overpressure condition.

The logic sequence illustrated in FIG. 10 is directed to liquid flow control. After receiving a drill signal at step 332, the controller 50 determines which of several water flow control modes has been selected, as is tested at steps 360, 368, and 372. At step 360, the controller 50 determines whether the automatic liquid pump control mode has been selected. If selected, the controller 50, at step 362, then determines whether the boring tool displacement rate exceeds the removal capability of the liquid flowing at a pre-selected rate. If the displacement rate exceeds the removal capability, the displacement rate is reduced, at step 364, until the liquid flow rate matches calculated flow requirements for the bore size. Alternatively, the liquid flow rate is increased, at step 364, until it reaches calculated flow requirements for the bore size.

If, at step 360, it is determined that the automatic liquid pump control mode of operation is not selected, the controller 50 then determines, at step 368, whether the variable liquid pump flow rate mode has been selected. If, at step 370, the variable rate mode has been selected, the liquid is pumped at the selected rate. If, however, the variable rate mode has not been selected, as is tested at step 368, the controller 50 then determines whether the full flow rate mode has been selected, at step 372. If the full flow rate mode has been selected, the liquid is pumped at full flow, as indicated at step 370. If the full flow rate mode has not been selected, the controller 50 disengages power to the liquid dispensing pump 58 at step 366.

The present invention as disclosed herein includes a control system for an underground boring machine 20. The control system advantageously provides for automatic control of the displacement and rotation rates of a boring tool 42 so as to increase drilling and reaming efficiency and maintain drilling conditions within safe operating parameters. It will, of course, be understood that various modifications and additions can be made to the preferred embodiments discussed hereinabove without departing from the scope or spirit of the present invention. Accordingly, the scope of the present invention should not be limited by the particular embodiments discussed above, but should be defined only by the claims set forth below.

What is claimed is:

1. A method for controlling a penetration speed of an underground cutting tool, comprising:

setting a speed of rotation of the cutting tool;

setting a rate of displacement of the cutting tool;

monitoring the speed of cutting tool rotation as the cutting tool is displaced at the set rate of displacement; and automatically modifying a rate of cutting tool displacement to achieve a predetermined rotational speed profile.

2. The method of claim 1, wherein monitoring the rotation speed further comprises monitoring a rate of change in the rotation speed, and automatically modifying the rate of cutting tool displacement further comprises modifying a rate of change in cutting tool displacement as a function of the rate of change in the rotation speed.

3. The method of claim 1, wherein the set rate of cutting tool displacement represents a maximum displacement rate, and automatically modifying the rate of cutting tool displacement further comprises modifying the rate of cutting tool displacement so as to avoid exceeding the maximum displacement rate.

4. The method of claim 3, wherein the predetermined rotational speed profile comprises a maximum rotation speed.

5. The method of claim 3, wherein the predetermined rotational speed profile comprises a minimum rotation speed and a maximum rotation speed.

6. The method of claim 1, further comprising:

setting a maximum rate of displacement;

setting the set rate of cutting tool displacement to a rate lower than the maximum displacement rate; and modifying the rate of cutting tool displacement further comprises increasing the rate of cutting tool displacement and limiting the rate of cutting tool displacement so as to avoid exceeding the maximum displacement rate.

7. The method of claim 6, wherein the predetermined rotational speed profile comprises a maximum rotational load.

8. The method of claim 6, wherein the predetermined rotational speed profile comprises a minimum rotation speed and a maximum rotation speed.

9. The method of claim 1, wherein automatic modification of the cutting tool displacement rate is accomplished within about 0.1 seconds to about 0.5 seconds.

10. The method of claim 1, further comprising:

setting a liquid flow rate;

calculating liquid flow requirements for a borehole produced by the cutting tool;

monitoring an actual rate of liquid flow into the borehole; and automatically reducing the cutting tool displacement rate in response to the liquid flow requirements exceeding the actual liquid flow rate.

11. The method of claim 10, wherein calculating the liquid flow requirements comprises calculating the liquid flow requirements based on a size of the borehole, a size of the cutting tool, and the cutting tool displacement rate.

12. The method of claim 1, further comprising:

calculating liquid flow requirements for a borehole produced by the cutting tool;

monitoring an actual rate of liquid flow into the borehole; and automatically adjusting the actual liquid flow rate such that the actual liquid flow rate equals or exceeds the calculated liquid flow requirements.

13. A method for controlling a penetration speed of an underground cutting tool, comprising:

setting a speed of rotation of the cutting tool;

setting a rate of displacement of the cutting tool;

setting a liquid flow rate;

monitoring the speed of cutting tool rotation as the cutting tool is displaced at the set rate of displacement;

automatically modifying a rate of cutting tool displacement to achieve a predetermined rotational speed profile; and automatically reducing the cutting tool displacement rate in response to calculated liquid flow requirements exceeding an actual rate of liquid flow into the borehole.

14. The method of claim 13, wherein the liquid flow requirements are calculated based on a size of the borehole, a size of the cutting tool, and the cutting tool displacement rate.

15. The method of claim 13, wherein the set rate of cutting tool displacement represents a maximum displacement rate, and automatically modifying the rate of cutting tool displacement further comprises modifying the rate of cutting tool displacement so as to avoid exceeding the maximum displacement rate.

16. The method of claim 15, wherein the predetermined rotational speed profile comprises a maximum rotation speed.

17. The method of claim 15, wherein the predetermined rotational speed profile comprises a minimum rotation speed and a maximum rotation speed.

18. The method of claim 13, further comprising:

setting a maximum rate of displacement;

setting the set rate of cutting tool displacement to a rate lower than the maximum displacement rate; and modifying the rate of cutting tool displacement further comprises increasing the rate of cutting tool displacement and limiting the rate of cutting tool displacement so as to avoid exceeding the maximum displacement rate.

19. The method of claim 18, wherein the predetermined rotational speed profile comprises a maximum rotation speed.

20. The method of claim 18, wherein the predetermined rotational speed profile comprises a minimum rotation speed and a maximum rotation speed.

21. The method of claim 13, wherein automatic modification of the cutting tool displacement rate is accomplished within about 0.1 seconds to about 0.5 seconds.

22. A method for controlling a penetration speed of an underground cutting tool, comprising:

setting a speed of rotation of the cutting tool;

setting a rate of displacement of the cutting tool;

monitoring the speed of cutting tool rotation as the cutting tool is displaced at the set rate of displacement;

automatically modifying a rate of cutting tool displacement while maintaining the speed of cutting tool rotation at the set speed of rotation to achieve a predetermined rotational speed profile; and automatically adjusting an actual liquid flow rate such that the actual liquid flow rate equals or exceeds calculated liquid flow requirements.

23. The method of claim 22, wherein the set rate of cutting tool displacement represents a maximum displacement rate, and automatically modifying the rate of cutting tool displacement further comprises modifying the rate of cutting tool displacement so as to avoid exceeding the maximum displacement rate.

24. The method of claim 23, wherein the predetermined rotational speed profile comprises a maximum rotation speed.

25. The method of claim 23, wherein the predetermined rotational speed profile comprises a minimum rotation speed and a maximum rotation speed.

26. The method of claim 22, further comprising:

setting a maximum rate of displacement;

setting the set rate of cutting tool displacement to a rate lower than the maximum displacement rate; and modifying the rate of cutting tool displacement further comprises increasing the rate of cutting tool displacement and limiting the rate of cutting tool displacement so as to avoid exceeding the maximum displacement rate.

27. The method of claim 26, wherein the predetermined rotational speed profile comprises a maximum rotation speed.

28. The method of claim 22, wherein automatic modification of the cutting tool displacement rate is accomplished within about 0.1 to about 0.5 seconds.

29. A system for controlling a penetration speed of an underground cutting tool, comprising:

a drill pipe to which the cutting tool is coupled;

a driving apparatus coupled to the drill pipe, the driving apparatus rotating the drill pipe at a set speed of rotation and displacing the pipe at a set rate of displacement; and a controller coupled to the driving apparatus, the controller monitoring the speed of cutting tool rotation as the cutting tool is displaced at the set rate of displacement, the controller modifying a rate of cutting tool displacement to achieve a predetermined rotational speed profile.

30. The system of claim 29, wherein the controller monitors a rate of change in the rotation speed and modifies a rate of change in cutting tool displacement as a function of the rate of change in the rotation speed.

31. The system of claim 29, wherein the set rate of cutting tool displacement represents a maximum displacement rate, and the controller modifies the rate of cutting tool displacement so as to avoid exceeding the maximum displacement rate.

32. The system of claim 31, wherein the predetermined rotational speed profile comprises a maximum rotation speed.

33. The system of claim 31, wherein the predetermined rotational speed profile comprises a minimum rotation speed and a maximum rotation speed.

34. The system of claim 29, wherein the controller, when increasing the rate of cutting tool displacement, limits the rate of cutting tool displacement so as to avoid exceeding the maximum displacement rate.

35. The system of claim 34, wherein the predetermined rotational speed profile comprises a maximum rotation speed.

36. The system of claim 34, wherein the predetermined rotational speed profile comprises a minimum rotation speed and a maximum rotation speed.

37. The system of claim 29, wherein the controller modifies the cutting tool displacement rate to achieve the predetermined rotational speed profile within about 0.1 seconds to about 0.5 seconds.

38. At The system of claim 29, wherein the controller calculates liquid flow requirements for a borehole produced by the cutting tool, monitors an actual rate of liquid flow into the borehole, and reduces the cutting tool displacement rate in response to the liquid flow requirements exceeding the actual liquid flow rate.

39. The system of claim 38, wherein the controller calculates the liquid flow requirements based on a size of the borehole, a size of the cutting tool, and the cutting tool displacement rate.

40. The system of claim 29, wherein the controller calculates liquid flow requirements for a borehole produced by the cutting tool, monitors an actual rate of liquid flow into the borehole, and adjusts an actual liquid flow rate such that the actual liquid flow rate equals or exceeds the calculated liquid flow requirements.

* * * * *